US006438783B1

(12) United States Patent
Reder et al.

(10) Patent No.: US 6,438,783 B1
(45) Date of Patent: Aug. 27, 2002

(54) MULTI-PURPOSE COMPUTER MONITOR ACCESSORY

(76) Inventors: Steven Gary Reder, 2832 D Black Forest Dr., St. Louis; Salvator J. Grillo, 5468 Chatfield, Oakville, both of MO (US) 63129

( * ) Notice: Subject to any disclaimer, the term of this patent is extended or adjusted under 35 U.S.C. 154(b) by 0 days.

(21) Appl. No.: 09/614,104

(22) Filed: Jul. 12, 2000

Related U.S. Application Data

(60) Provisional application No. 60/143,486, filed on Jul. 12, 1999.

(51) Int. Cl.[7] ..... A47L 13/40

(52) U.S. Cl. ..... 15/105; 254/28

(58) Field of Search ..... 15/104.001, 105, 15/105.52, 106, 111, 160; 254/28; D4/116, 118

(56) References Cited

U.S. PATENT DOCUMENTS

| | | | | |
|---|---|---|---|---|
| D117,933 | S | * | 12/1939 | Manchester et al. |
| 2,464,321 | A | * | 3/1949 | Konczal |
| 3,039,435 | A | * | 6/1962 | Meyer |
| 3,837,747 | A | | 9/1974 | Seymore |
| 4,602,401 | A | | 7/1986 | Holroyd |
| 5,062,672 | A | * | 11/1991 | Harris |
| 5,347,676 | A | | 9/1994 | Saitoh |
| D354,595 | S | | 1/1995 | Wasak |
| 5,487,203 | A | | 1/1996 | Brach |
| 5,528,793 | A | | 6/1996 | Schbot |
| 5,924,153 | A | | 6/1999 | Salley |
| 6,058,550 | A | | 5/2000 | Kruger |
| 6,182,320 | B1 | * | 2/2001 | Hruger et al. |

* cited by examiner

*Primary Examiner*—Terrence R. Till
(74) *Attorney, Agent, or Firm*—Dennis A. Bennett

(57) ABSTRACT

There is disclosed a multi-purpose computer duster that is capable of cleaning a monitor, keyboard and the like. In addition there is an optional staple remover integrated into the blade section of the duster.

7 Claims, 2 Drawing Sheets

MULTI-PURPOSE COMPUTER MONITOR ACCESSORY

This application claims the benefit of provisional application No. 60/143,486 filed Jul. 12 1999.

FIELD OF THE INVENTION

The present invention relates to a computer monitor accessory, more particularly this invention provides a multi-purpose computer duster and staple remover.

BACKGROUND OF THE INVENTION

There is a need to clean computer monitors and keyboards of dust and the like. There have been numerous attempts to develop devices capable of doing this task in a cost effective and convent manner. For example both U.S. Pat. Nos. 5,924,153 and 6,058,550, which are incorporated herein by reference, disclose a video display screen cleaner that can remove dust from a monitor. However, U.S. Pat. No. 5,924,153 is not easily secured to the computer. Nor can U.S. Pat. No. 6,058,550 can be used to clean in between the keyboard keys like the present invention. In addition U.S. Pat. No. 6,058,550 requires that the device be held in a precise angle to clean the monitor. Whereas the present invention does not require that the device be held at a particular angle to be used.

SUMMARY OF THE INVENTION

There is disclosed a mulit-purpose computer duster that is capable of cleaning a monitor, keyboard and the like. In addition there is an optional staple remover integrated into the blade section of the duster.

DETAILED DESCRIPTION OF THE INVENTION

Figure 1:
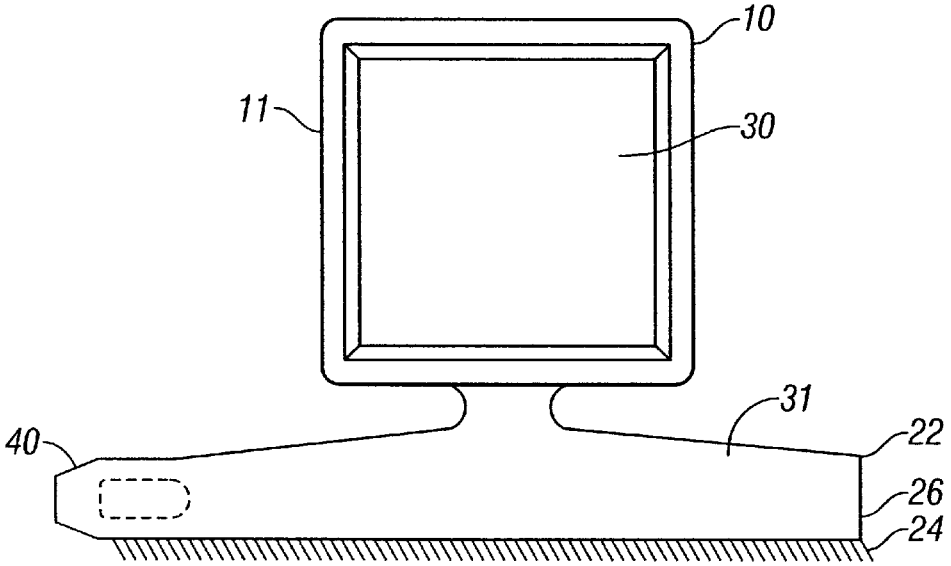
FIG. 1 shows a front view of the present invention.
Figure 2:
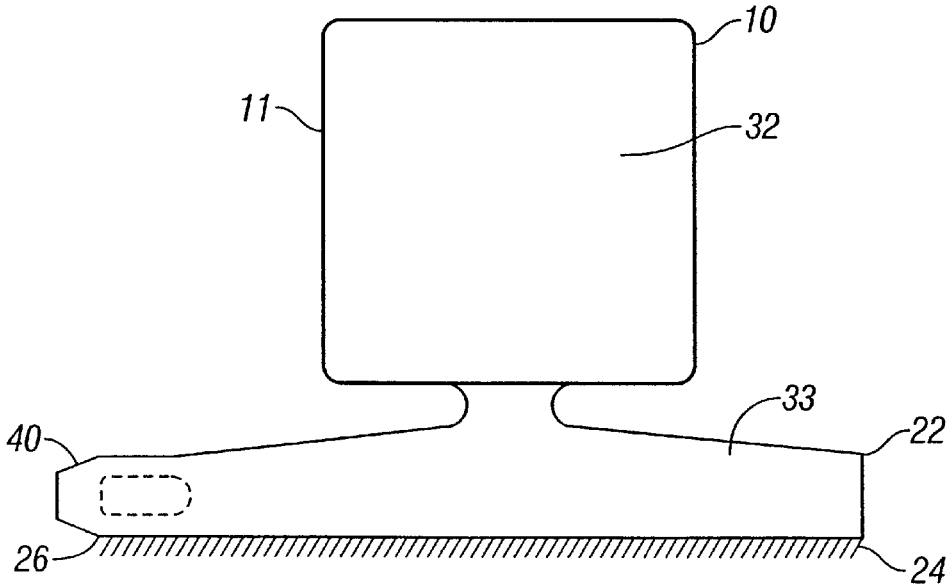
FIG. 2 shows a back view of the present invention.
Figure 3:
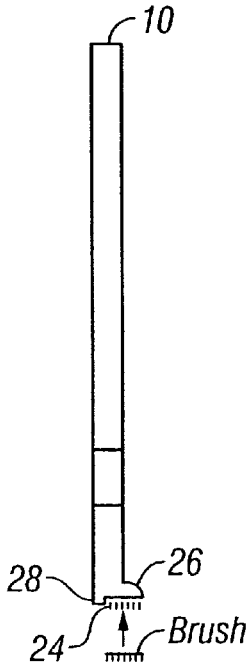
FIG. 3 shows a side view of the present invention.

With reference to the accompanying drawings, FIGS. 1, 2 and 3 shows a preferred embodiment of the present invention, generally designated as numeral 10. The present invention 10 is preferably made plastic such as high impact styrene in a standard process of injection molding.

The multi-purpose accessory 10 generally comprises handle 11 attached to blade 22. Blade 22 is preferably wider than handle 11 but does not have to be. Blade 22 has felt, a brush or weather stripping or the like 24 attached to the bottom 26. The brush 24 is preferably dimensioned to run about the fill length of blade 22. However the brush can be made shorter without affecting the cleaning power of the duster 10. Brush 24 is about the same thickness as the handle 11 and blade 22. Brush 24 is between 1–4 mm.

In the preferred example a lip 28 is formed at bottom 26. This lip 26 provides for added strength and/or support to brush 24. However, the brush could be secured or glued to the bottom 26 without the lip.

On the edge of blade 22 is formed an optional staple remover 40. Staple remover 40 adds yet another added utility to the multi-purpose accessory 10.

The shape of the handle 11 can be changed to any design. In the preferred embodiment handle 11 is the shape of a house. However, it could easily be the shape of a computer, car, train and/or any geometric design. The shape of the handle 11 will be based on a customer's specification. It is usually related to what is imprinted and/or molded inside imprint areas 30, 31, 32, 33 and 34. Within imprint areas 30, 31, 32, 33 and 34 there can be printed any desired message from the customer, like a logo, sales message or the like.

Figure 4:
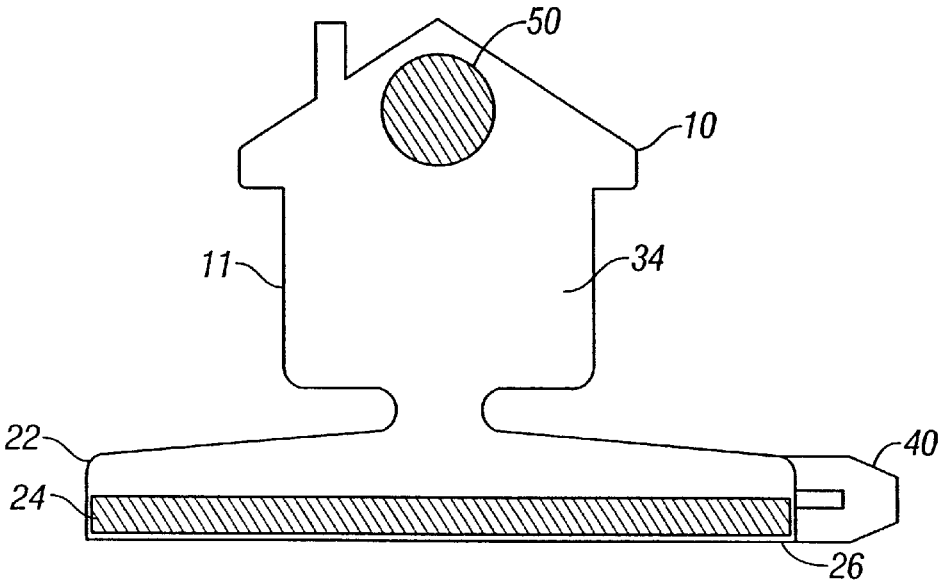
FIG. 4 shows a back view of another embodiment of the present invention.

FIG. 4 discloses another preferred embodiment with the brush 24 attached to the back side of blade 22 with optional staple remover 40 on blade 22. FIG. 4 also discloses Hook/loop attachment 50 which can be attached to handle 26. Attachment 50 allows for the multi-purpose accessory 10 to be removable attached to a computer monitor any other device where it can be used. The hook/loop 50 can be deleted altogether.

The monitor cleaner 10 can remove/clean dust from screens of monitors, laptops, t.v.'s., or picture frames. This can be done by running the blade 22 which has felt 24 along the surface of the item that is to be cleaned. However, unlike previous dusters in the art, when using the embodiment disclosed in FIGS. 1, 2 and 3 the user does not have to be concerned with having to have the duster 10 at a precise angle. The present invention allows for the duster to be used over an entire 180 degrees. Beyond being able to clean the monitor multi-purpose accessory 10 is able to be used to clean in between cracks such as the keys on a keyboard.

Since various modifications can be made in the invention as hereinabove described, and many different embodiments of same can be made within the spirit and scope of the claims without departing from such spirit and scope, it is intended that all matter contained in the accompanying specification shall be interpreted as illustrative only and not in a limiting sense.

What is claimed is:

1. A screen cleaner comprising:

a handle having a front surface, a back surface, top and bottom;

an elongated blade having two side edges, a front surface, a back surface, top and bottom wherein said elongated blade is wider than said handle and said top of said elongated blade is attached to said bottom of said handle;

a brush having about the same thickness as said handle and is attached along said bottom of said blade; and a lip attached to said bottom of the blade.

2. A screen cleaner comprising:

a handle having a front surface, a back surface, top and bottom;

an elongated blade having two side edges, a front surface, a back surface, top and bottom wherein said elongated blade is wider than said handle and said top of said elongated blade is attached to said bottom of said handle;

a brush having about the same thickness as said handle and is attached along said bottom of said blade; and a removable attachment means attached to said back surface of said handle.

3. A screen cleaner comprising:

a handle having a front surface, a back surface, top and bottom;

an elongated blade having two side edges, a front surface, a back surface, top and bottom wherein said elongated blade is wider than said handle and said top of said elongated blade is attached to said bottom of said handle;

a brush having about the same thickness as said handle and is attached along said bottom of said blade; and a staple remover integrated into one edge of said elongated blade.

4. A method of cleaning a surface of a computer monitor or keyboard comprising the steps of:

applying a screen cleaner to the surface wherein said screen cleaner is positioned adjacent to the surface, said screen cleaner comprising a handle having a front surface, a back surface, top and bottom; an elongated blade having two side edges, a front surface, a back surface, top and bottom wherein said elongated blade is wider than said handle and said top of said elongated blade is attached to said bottom of said handle; and a brush having about the same thickness as said handle and is attached along said bottom of said blade, and moving said screen cleaner along the surface in any direction.

5. A screen cleaner, comprising:

a handle having a front surface, a back surface, top and bottom;

an elongated blade having two side edges, a front surface, a back surface, top and bottom;

said elongated blade is wider than said handle;

said top of said elongated blade is attached to said bottom of said handle;

a brush having about the same thickness as said handle is attached to said blade; and a staple remover integrated into one edge of said elongated blade section.

6. The screen cleaner as recited in claim 5 wherein said brush is attached to the bottom of said blade.

7. The screen cleaner as recited in claim 6 further comprising a removable attachment means attached to said back surface of said handle.

* * * * *